US006286530B1

(12) United States Patent
Hussey

(10) Patent No.: US 6,286,530 B1
(45) Date of Patent: Sep. 11, 2001

(54) RECONFIGURABLE SUN SHADE AND SHELTER APPARATUS

(76) Inventor: Richard Hussey, 41 Ehrbar Ave., Apt. #1B, Mount Vernon, NY (US) 10552

( * ) Notice: Subject to any disclaimer, the term of this patent is extended or adjusted under 35 U.S.C. 154(b) by 0 days.

(21) Appl. No.: 09/337,218

(22) Filed: Jun. 20, 1999

(51) Int. Cl.[7] ..... E04H 15/28
(52) U.S. Cl. ..... 135/98; 135/20.1; 135/99
(58) Field of Search ..... 135/98, 99, 20.1

(56) References Cited

U.S. PATENT DOCUMENTS

| | | | | |
|---|---|---|---|---|
| 554,792 | * | 2/1896 | Pittenger et al. | 135/98 X |
| 572,843 | * | 12/1896 | Van Vechten | 135/98 X |
| 2,743,734 | * | 5/1956 | Terrell et al. | 135/98 |
| 3,252,469 | * | 5/1966 | Peake | 135/98 X |
| 3,429,320 | * | 2/1969 | Edelkind | 135/20.1 |
| 5,046,699 | | 9/1991 | Perreault et al. . | |
| 5,152,495 | | 10/1992 | Jacinto et al. . | |
| 5,156,369 | | 10/1992 | Tizzoni . | |
| 5,249,591 | * | 10/1993 | Gamadi | 135/98 |
| 5,816,276 | * | 10/1998 | Seidel et al. | 135/98 X |
| 5,845,665 | | 12/1998 | Koehn . | |
| 5,972,310 | * | 7/1999 | Lin | 135/20.1 |

FOREIGN PATENT DOCUMENTS

| | | |
|---|---|---|
| 1165212 | 10/1958 | (FR) . |
| 1436059 | 12/1966 | (FR) . |

* cited by examiner

*Primary Examiner*—Christopher T. Kent
(74) *Attorney, Agent, or Firm*—George M. Macdonald

(57) ABSTRACT

A reconfigurable sun shade and shelter apparatus that includes a flexible shade cover that is substantially square attached to a plurality of support ribs and a central locking control hub, the support ribs each having an inside end that is pivotally connected to the central locking control hub and an outside end that is removably connected to the flexible shade cover, the central locking control hub further including locking pivot means for independently pivoting each of the plurality of support ribs such that each support pole can independently be positioned in any one of a plurality of pivot positions and be locked into that pivot position.

20 Claims, 9 Drawing Sheets

FIG. 3
FIG. 3a
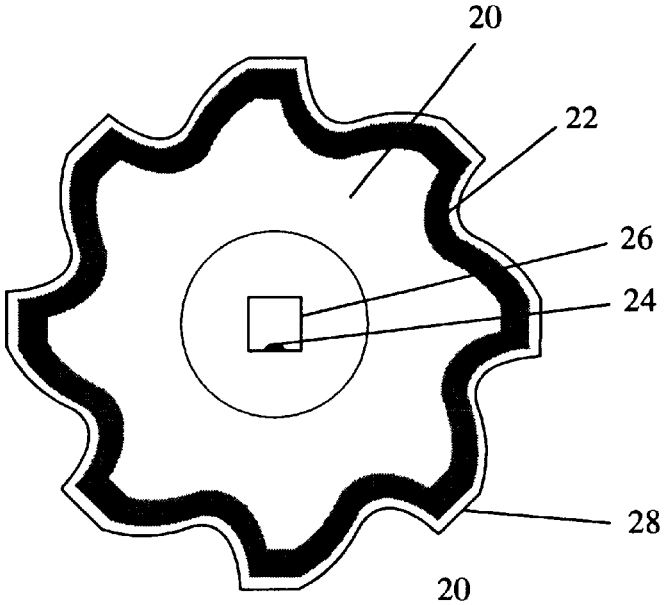
FIG. 3b
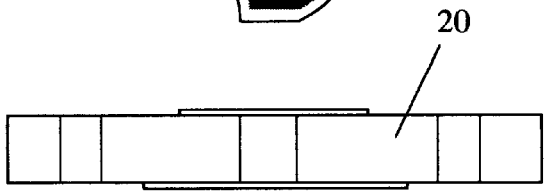
FIG. 3c
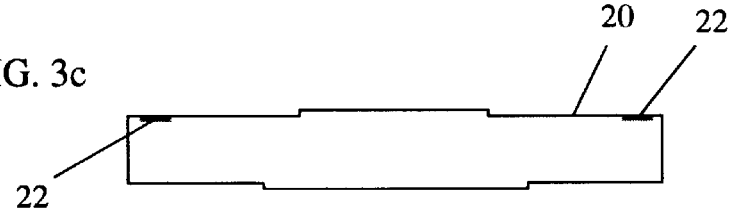
FIG. 3d
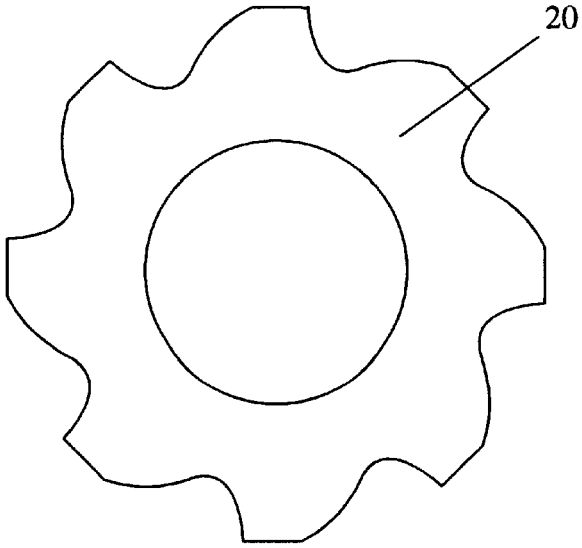

FIG. 7
FIG. 7a
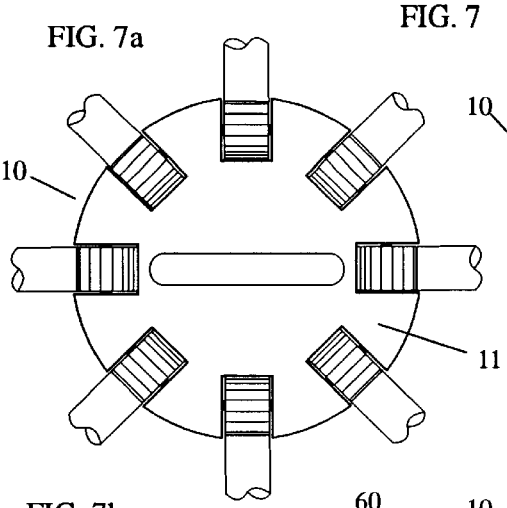
FIG. 7d
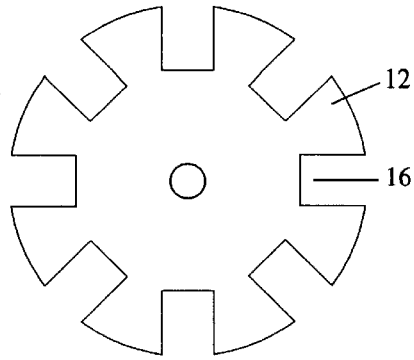
FIG. 7b
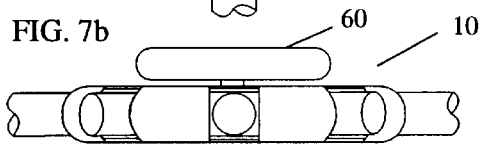
FIG. 7e
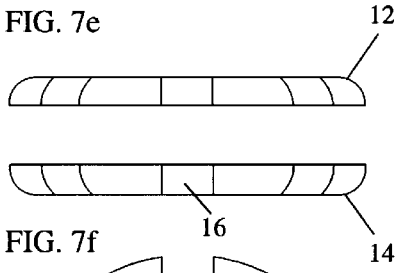
FIG. 7c
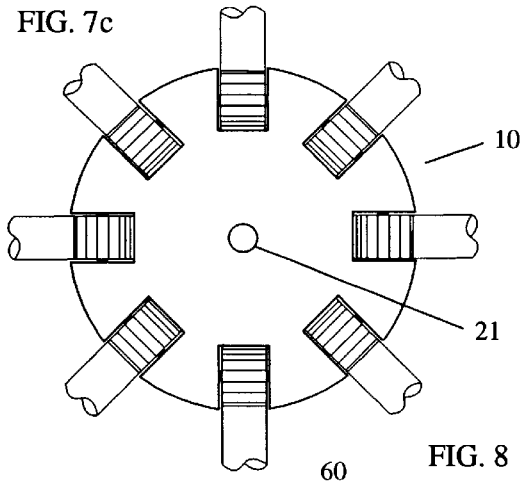
FIG. 7f
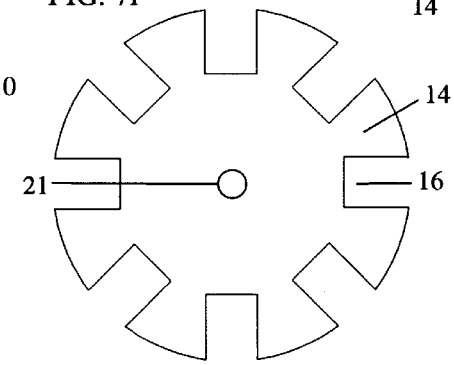
FIG. 8
FIG. 8a
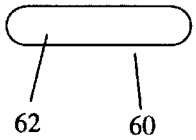
FIG. 8b
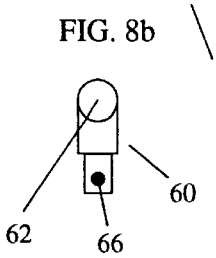
FIG. 8c
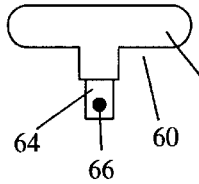
FIG. 8d
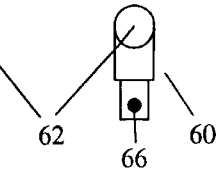
FIG. 8e
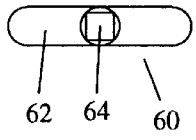

FIG. 9
FIG. 9a
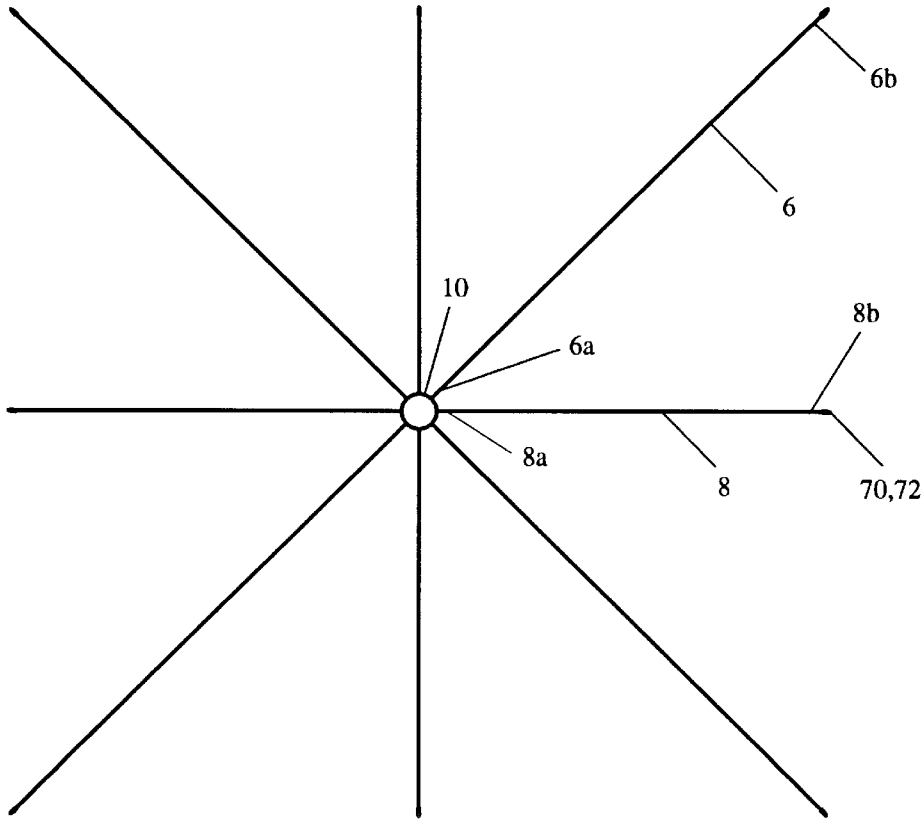
FIG. 9b
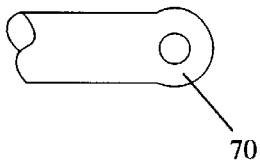
FIG. 9c
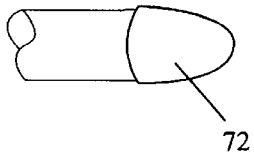

FIG. 10
FIG. 10a
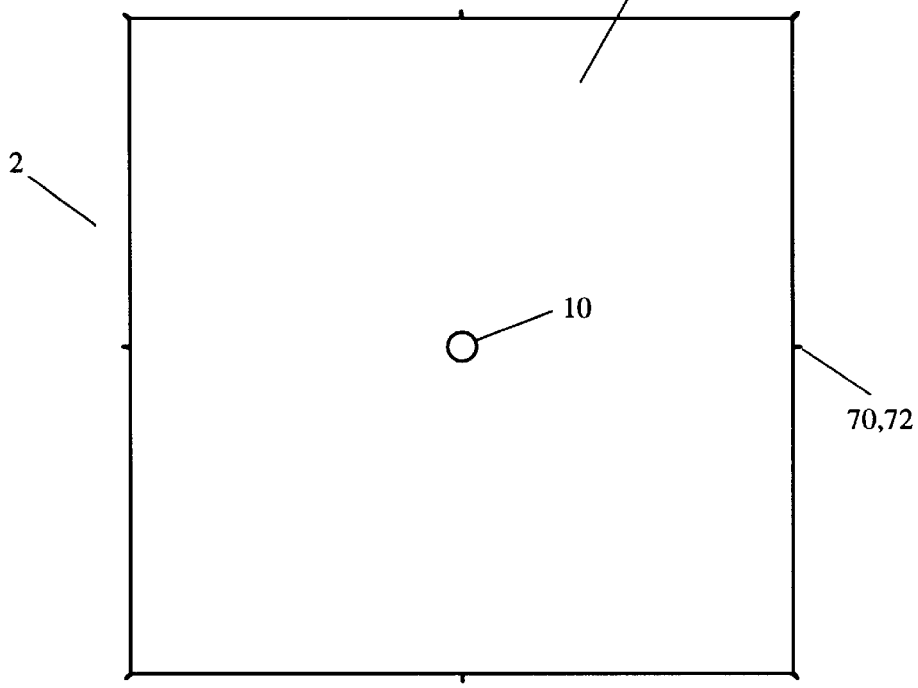
FIG. 10b
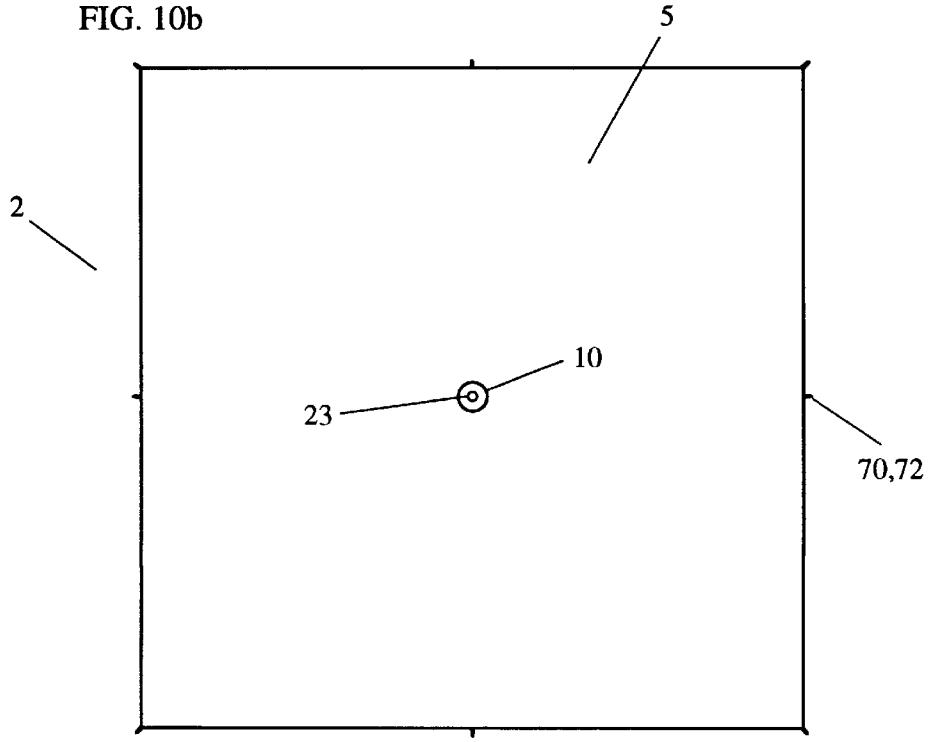

FIG. 12
FIG. 12a
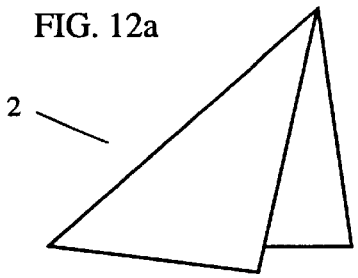
FIG. 12d
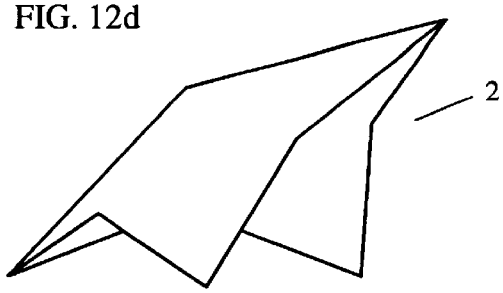
FIG. 12b
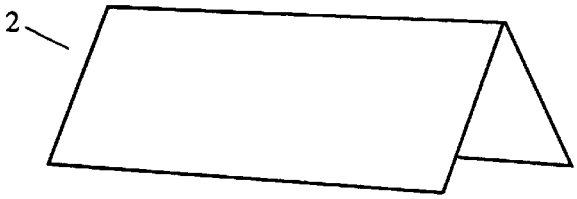
FIG. 12e
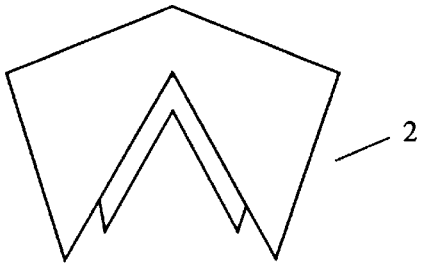
FIG. 12c
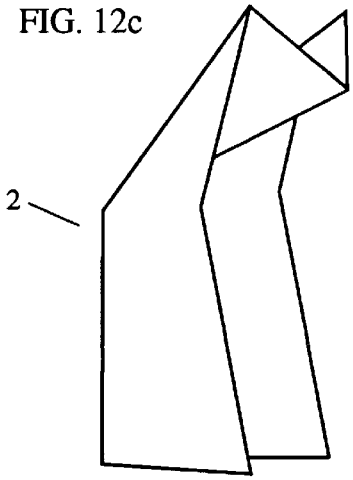
FIG. 12f
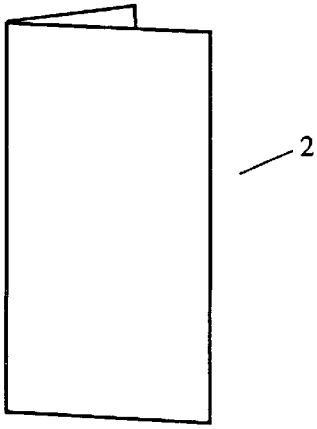

FIG. 13
FIG. 13a
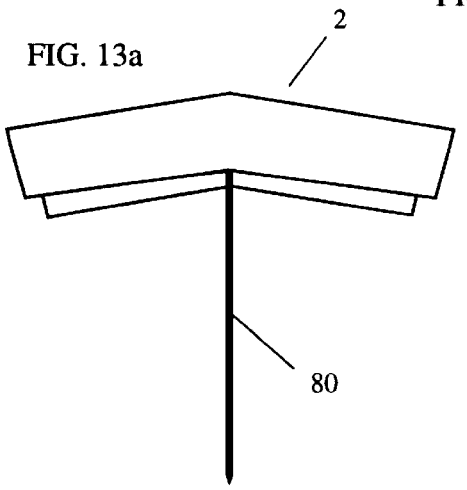
FIG. 13d
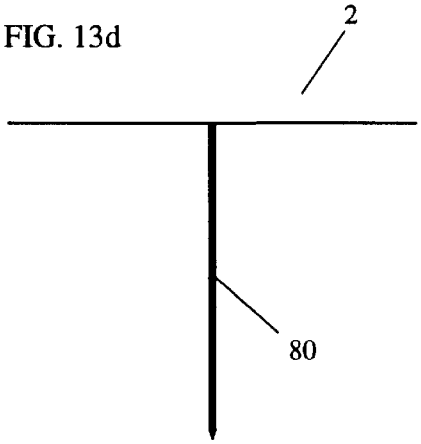
FIG. 13b
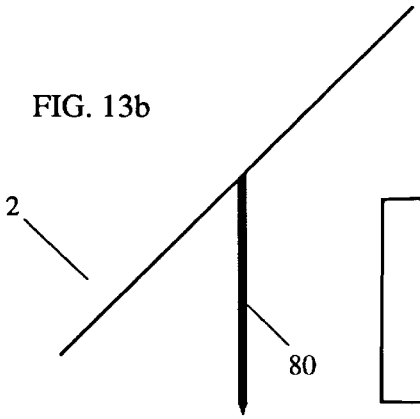
FIG. 13e
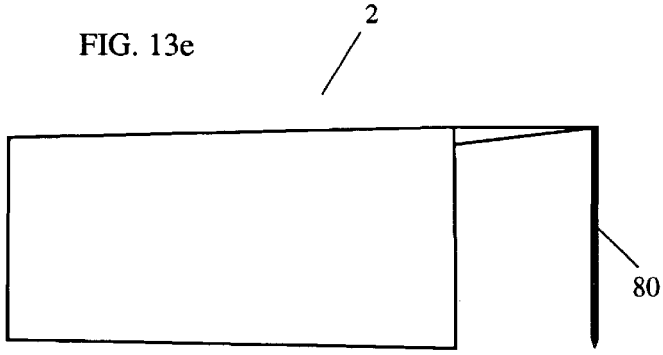
FIG. 13c
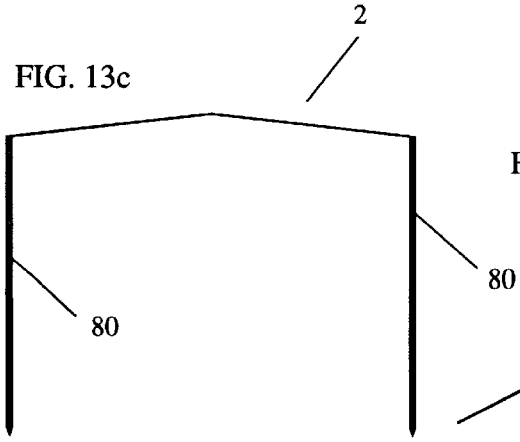
FIG. 13f
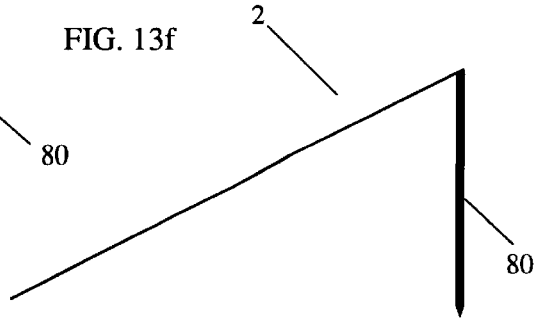

RECONFIGURABLE SUN SHADE AND SHELTER APPARATUS

BACKGROUND OF THE INVENTION

1. Field of the Invention

While a well-tanned complexion had become a symbol of good health and vitality in the last few decades, medical research has more recently linked overexposure to the sun with premature aging and skin cancer. As awareness of this danger increases, demand for sun screen products and umbrellas to provide shade increases.

This invention relates to a reconfigurable sun shade and shelter apparatus, and more particularly for a reconfigurable sun shade and shelter comprising at least one novel control hub for configuring the sun shade and shelter apparatus in one of a plurality of configurations.

2. Description of Related Art

Traditional shade umbrellas have several disadvantages in that they are often heavy, hard to handle, require a specific mounting, and do not always provide a high degree of protection from the sun. While traditional shade umbrellas are usually easily mounted in sand or soft earth, they have the disadvantage in that they are not easily mounted on a hard surface. Traditional shade umbrellas can be deployed either in only the fully open vertical position, or in some cases, the canopy may be tilted with respect to the vertical base. A further disadvantage of traditional shade umbrellas is that they do not perform well in high wind conditions.

Traditional shade umbrellas can be aesthetically pleasing and are often used in home gardens and for covering patio furniture. Traditional patio umbrella shade structures are often used as semi-permanent structures. The cloth or fabric that covers the frame of the semi-permanent shade structure deteriorates from the effects of rain, wind and sun. Accordingly, such structures are capable of being folded to minimize exposure to the elements. The folding mechanisms are often cumbersome and difficult to operate.

A further disadvantage of traditional shade umbrellas is a centrally located support shaft. This centrally located support shaft reduces the available usable area covered by the umbrella. Accordingly, towels or picnic blankets and the like must be arranged to avoid the central support shaft. Furthermore the shaded area shifts between sunrise and sunset, and articles protected beneath the umbrella must be shifted if continuous shade is required. A further disadvantage of traditional shade umbrellas is that they do not provide protection from wind.

A disadvantage of tents and canopies is that they are not easily reconfigurable for use in varied situations.

OBJECTS AND SUMMARY OF THE INVENTION

This invention relates to a reconfigurable sun shade and shelter apparatus. This device can provide shade from the sun and protection from wind and rain. The invention relates more particularly to a reconfigurable sun shade that is convenient and portable.

The present invention aims to alleviate the above disadvantages and to provide a reconfigurable sun shade and shelter which will be reliable and effective in use. The square shape of the preferred embodiment and the central locking control hub allow the sun shade and shelter to be reconfigured into many useful shapes.

The reconfigurable sun shade and shelter apparatus includes a central locking control hub and a plurality of support ribs that support a flexible shade cover. Alternatively, the reconfigurable sun shade and shelter apparatus includes a plurality of central locking control hubs. The central locking control hub allows the plurality of support ribs to be independently displaced at various angles in a vertical direction from one another in relation to the horizontal plane of the central locking control hub.

As will be appreciated, the plurality of support ribs of the reconfigurable sun shade and shelter apparatus support the flexible shade cover. The support ribs may be locked into many configurations in which any of the ribs are displaced at different angles from the central locking control hub. As described herein, the sun shade and shelter apparatus can be reconfigured into many shapes for use in different situations. The central locking control hub is preferably locked by a cam being moved into a locked position which pushes a locking piston along a cylinder in the housing of the central locking control hub thereby engaging a pivot mount attached to the hub. Each pivot mount is attached to a corresponding support rib which can be independently rotated vertically before the hub is locked.

The various parts of the central locking control hub can be constructed of plastic, metal alloy, fiberglass or other suitable material. The housing preferably comprises plastic parts including two housing halves to create a housing with an opening for a cam and 8 cylinder openings. The housing halves when combined create an opening for the cam to freely rotate when the key is turned. The housing halves comprise pivot pin channels for mounting the pivot pins. The housing halves may be fastened by glue or preferably the parts are fastened by screws.

The cental locking control hub comprises a key to lock and unlock the hub. In the preferred embodiment, the key is a T shaped key and the top of the T shape is contoured to fit comfortably in the palm of the operator's hand. The base of the key is preferably a square with detent holes in the four sides to engage a matching detent ball in the matching key receptacle in the central locking control hub. Alternatively, the key does not have to be temporarily locked into the central locking control hub when engaged. The key receptacle could be on either the bottom or top of the central locking control hub, or a receptacle could be on each side. The preferred embodiment comprises a key that resembles a T shaped handle, however a configuration using a standard hex key is possible. Alternatively, the key can be non-removable and can be part of the housing.

The key receptacle is attached to the cam that is displaced in a cylindrical opening at the center of the housing of the central locking control hub. Alternatively, the cam is mounted in the housing using ball bearings in the housing of the central locking control hub.

The cam has a plurality of cam lobes used to engage the locking pistons. In the preferred embodiment there are 8 cam lobes equally spaced from each other. A groove is situated in the top side of the cam and the groove continues along the perimeter of the cam for receiving each engaging pin of the corresponding locking piston such that the rotation of the cam will move the locking piston engaging pin along the cam channel thereby moving the locking piston along the cylinder formed in the housing of the central locking control hub. Alternatively, each locking piston could be spring loaded and the cam could use the face of each lobe to force the locking piston along the cylinder to be later returned by the spring.

Each locking piston engages a corresponding pivot mount that is preferably rotatably connected to the housing of the central locking control hub by a pin mounted in a channel in the housing of the central locking control hub. The pivot mount preferably comprises an inner end that is cylindrical from a side view and an outer end that attaches to the corresponding support rib. The pin is situated in a cylindrical opening in the center of the pivot mount that allows the pivot mount to pivot about the pin in a vertical plane from the central locking control hub. Each pivot mount may independently pivot vertically at different angles from the central locking control hub. Each pivot mount is rotatably connected to the housing of the central locking control hub toward the outer end of a cylinder formed in the housing of the central locking control hub. In the preferred embodiment, the inside cylindrical end of the pivot mount comprises a plurality of teeth of a gear. The portion of the locking piston situated away from the cam is then configured with a partial inside cylinder with teeth to engage the teeth of the pivot mount.

Alternatively, the matching surfaces of the locking piston and the pivot mount could be engaged by friction on a surface such as rubber mating surfaces. Furthermore the matching surfaces of the locking piston and the pivot mount could be engaged by a tapered pin on the end of the locking piston and a matching receptacle on the inside end of the pivot mount. Alternatively, the support ribs can be connected to the central locking control hub via a ratchet mechanism. Accordingly, the support ribs would not release under the force of gravity when the key is turned to the unlocked position.

Alternatively, the central locking control hub may use means other than a cam to engage the plurality of locking pistons with the corresponding pivot mounts in order to lock each pivot mount into a particular angle from the horizontal plane. A closed hydraulic system would comprise a pump or spring loaded piston that would create hydraulic pressure forcing a spring loaded locking pin to engage a pivot mount, thereby locking the pivot mount in place.

The reconfigurable sun shade and shelter apparatus includes a flexible shade cover that is substantially square and may be opaque, partially opaque or translucent. The flexible shade cover may be removable for ease of cleaning. The flexible shade cover may be waterproof to provide shelter from rain. The flexible shade cover may incorporate a vent system to provide stability in high winds. The shade cover may be constructed of various materials including fabric, stretch fabric, coated fabric, canvas, plastic, stretch plastic, nylon, polyvinyl and other materials such as those useful for constructing tents and umbrellas. Furthermore, the flexible shade cover may comprise several panels which may have varied levels of opacity and may be suitable for presenting advertisements. Furthermore, the flexible shade cover may comprise a plurality of panels that may independently be replaced with spare panels allowing for changing opacity or advertisements. Additionally, the shade cover may include interior pockets or hooks.

The flexible shade cover is attached to a plurality of support ribs. The support ribs are preferably fiberglass and may be constructed of a variety of materials such as those used in tent manufacture including plastic, fiberglass and aluminum alloys. Due to the square configuration of the flexible shade cover, the first preferred embodiment comprises 8 support ribs, 4 shorter ribs displaced at 0, 90, 180 and 270 degrees and 4 longer ribs displaced at 45, 135, 225 and 315 degrees. Each support rib is attached to a corresponding pivot mount that has an inner end that is pivotally connected to the housing of the central locking control hub. The pivot mount can be attached to the ribs by adhesive, a screw arrangement as in plumbing pipes or other coupling means such as a sleeve connected to each piece. Alternatively, the support ribs and pivot mount may be constructed in one piece.

Alternatively, the outer end of each support rib may comprise a support pole mount for fastening a support pole, fastening rope or tent stake and a removable cover for each support pole mount. The removable support rib cover can be constructed of a soft rubber material press fit over the end of the support rib or a cover that screws onto the end of the support rib. Additionally, clips or other fasteners may be provided to secure adjacent panels when so configured in order to provide additional structural support. The support ribs may have ends suitable for use as a spike to secure the apparatus in sand.

The fiberglass support ribs can be covered with a flexible shade cover comprising a substantially square sheet of material, such as a stretchable waterproof fabric or preferably stretch plastic such as nylon, and strips of material, preferably nylon, bonded to the top sheet forming support pole channels. The removable flexible shade cover can be mounted to the support ribs using a hook and loop fastener such as Velcro or other fastener such as snap fasteners.

The housing of the central locking control hub comprises a mount for a support pole allowing the reconfigurable sun shade and shelter apparatus to be configured as an umbrella. The mount can be a high-resistance universal pivot mount.

In a first preferred embodiment, the reconfigurable sun shade and shelter apparatus includes a flexible shade cover that is substantially square. The flexible shade cover is attached to 8 support ribs and a central locking control hub by fasteners and can be removed. The support ribs each have an inside end that is connected to an outer end of a corresponding pivot mount using a removable sleeve. Each pivot mount is pivotally connected to a housing of a central locking control hub using a metal pin and nylon washers. The other parts of the central locking control hub are constructed of plastic. The central locking control hub comprises a cam and key to actuate the cam. The cam has a cam channel in which a plurality of locking pistons are slidably connected to the cam channel, thereby allowing the 8 support ribs to be locked at various vertical angles from the horizontal plane of the central locking control hub.

Preferably, the reconfigurable sun shade and shelter apparatus comprises 8 support ribs, preferably constructed from fiberglass, that are spaced at substantially 45 degree angles from each other and each pivotally attached to a central locking control hub, resembling spokes from a wheel hub. The fiberglass support ribs can pivot vertically from the central locking control hub, thereby causing the flexible shade cover to be repositioned and thereby reconfiguring the sun shade and shelter apparatus. The fiberglass support ribs are covered with a flexible shade cover comprising a substantially square sheet of material, preferably a stretchable waterproof fabric or stretch plastic such as nylon and fastened to the support ribs using Velcro fasteners. Due to the substantially square shape, the four corner support ribs are longer than the four central support ribs. The central locking control hub comprises metal pivot pins, nylon washers and remaining parts made of plastic. The central locking control hub further comprises a cam with a cam channel, 8 locking pistons and 8 pivot mounts situated in the 8 cylinders, each pivot mount and locking piston having teeth that mate on the matching surface in the cylinder, pivot pins to connect the pivot mount to the housing and a key to operate the cam.

In a second embodiment, the reconfigurable sun shade and shelter apparatus has a bottom sheet that is sewn or bonded to the top sheet with the support ribs in between the two sheets and an opening for the cam key.

In a third embodiment, the central locking control hub comprises receiving means for a vertical support pole on the bottom.

In a fourth embodiment, the central locking control hub comprises pin locking means comprising a plurality of locking pistons each with a tapered pin and a plurality of pivot mounts each with a corresponding socket to engage the lock of the central locking control hub.

In a fifth embodiment, the central locking control hub comprises pivot locking means comprising friction coupling means coupling the support pole mounts to the central locking control hub.

In a sixth embodiment, the central locking control hub comprises a pivot locking means comprising a ratchet coupling means coupling the support pole mounts to the central locking control hub.

In a seventh embodiment, the reconfigurable sun shade and shelter apparatus comprises a plurality of central locking control hubs.

Furthermore, the reconfigurable sun shade and shelter apparatus has many configurations that would result in shade panels visible to a person walking by. While the traditional umbrella is not effective for advertisements, the reconfigurable sun shade and shelter apparatus has replaceable shade panels that could carry advertisements. Similarly, several substantially opaque panels could be replaced by translucent panels or partially translucent panels to allow occupants of the reconfigurable structure to see through the device.

This invention has particular beneficial application as a reconfigurable structure for use as a sun shade and for illustrative purposes reference will be made to such application. However, a reconfigurable structure for use as a sun shade is not the exclusive application for this invention and it is to be understood that this invention could be used in other applications such as for temporary accommodation and protection from other elements such as wind and rain.

BRIEF DESCRIPTION OF THE DRAWINGS

In order that this invention may be more readily understood and put into practical effect, reference will now be made to the accompanying drawings which illustrate typical embodiments of the invention and wherein:

FIG. 3*a* is a top view of the cam;

FIG. 3*b* is a side view of the cam;

FIG. 3*c* is a side cutaway view of the cam;

FIG. 3*d* is a bottom view of the cam;

FIG. 7*a* is a top view of a central locking control hub;

FIG. 7*b* is a side view of a central locking control hub;

FIG. 7*c* is a bottom view of a central locking control hub;

FIG. 7*d* is a top view of a top housing half;

FIG. 7*e* is a side view of top and bottom housing halves;

FIG. 7*f* is a bottom view of a bottom housing half;

FIG. 8*a* is a top view of a key;

FIG. 8*b* is a front view of a key;

FIG. 8*c* is a side view of a key;

FIG. 8*d* is a rear view of a key;

FIG. 8*e* is a bottom view of a key;

FIG. 9*a* is a top view of a central locking control hub and support ribs;

FIG. 9*b* is a side view of an outside end of a support rib;

FIG. 9*c* is a side view of an outside end of a support rib with cap;

FIG. 10*a* is a top view of a reconfigurable sun shade and shelter apparatus;

FIG. 10*b* is a bottom view of a reconfigurable sun shade and shelter apparatus;

FIG. 12*a* is an angled side view of a reconfigurable sun shade and shelter apparatus in one fixed position;

FIG. 12*b* is an angled side view of a reconfigurable sun shade and shelter apparatus in one fixed position;

FIG. 12*c* is an angled side view of a reconfigurable sun shade and shelter apparatus in one fixed position;

FIG. 12*d* is an angled side view of a reconfigurable sun shade and shelter apparatus in one fixed position;

FIG. 12*e* is an angled side view of a reconfigurable sun shade and shelter apparatus in one fixed position;

FIG. 12*f* is an angled side view of a reconfigurable sun shade and shelter apparatus in one fixed position;

FIG. 13*a* is a side view of a reconfigurable sun shade and shelter apparatus with support pole in one fixed position;

FIG. 13*b* is a side view of a reconfigurable sun shade and shelter apparatus with support pole in one fixed position;

FIG. 13*c* is a side view of a reconfigurable sun shade and shelter apparatus with support poles in one fixed position;

FIG. 13*d* is a side view of a reconfigurable sun shade and shelter apparatus with support pole in one fixed position;

FIG. 13*e* is a side view of a reconfigurable sun shade and shelter apparatus with support poles in one fixed position;

FIG. 13*f* is a side view of a reconfigurable sun shade and shelter apparatus with support poles in one fixed position;

DETAILED DESCRIPTION OF THE PREFERRED EMBODIMENTS

Figure 1:
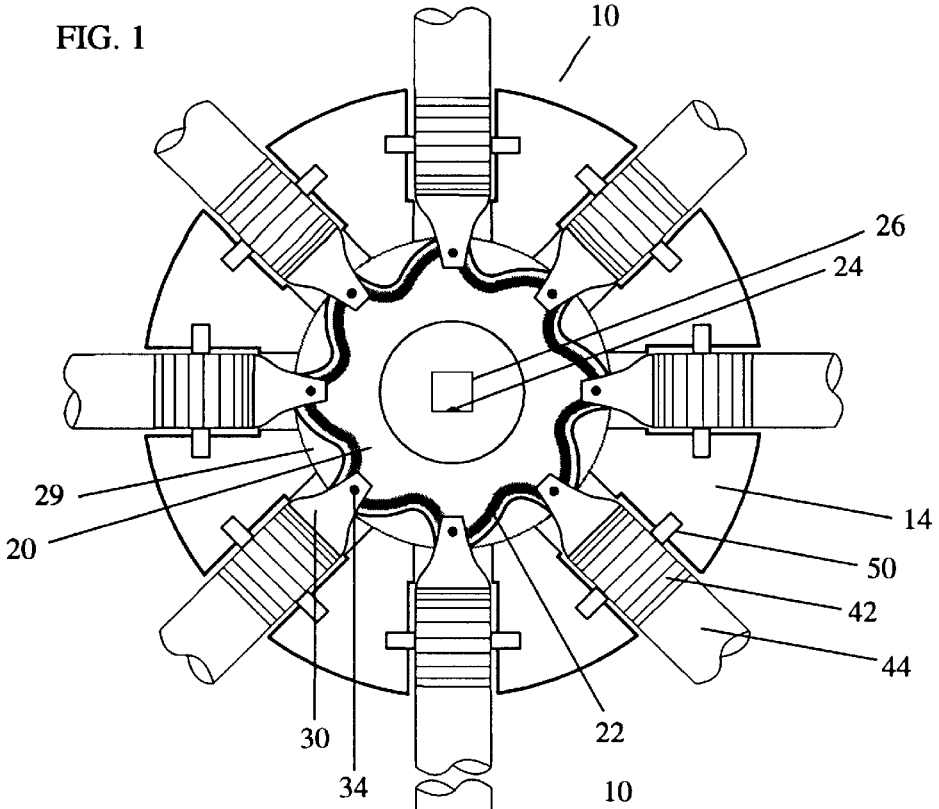
FIG. 1 is a top view with cut away of a central locking control hub in locked position of a reconfigurable sun shade and shelter apparatus constructed in accordance with the first preferred embodiment.

The reconfigurable sun shade and shelter apparatus 2 illustrated in FIGS. 1 to 10*a* comprises a flexible shade cover that is substantially square 4 attached to a plurality of support ribs 6 and 8 and a central locking control hub 10, the support ribs 6, 8 each having an inside end 6*a*, 8*a* that is pivotally connected to the central locking control hub 10 and an outside end 6*b*, 8*b* that is removably connected to the flexible shade cover 4. The central locking control hub 10 further comprising locking pivot means for independently pivoting each of the plurality of support ribs 6, 8 such that each support rib can independently be positioned in any one of a plurality of pivot positions and be locked into that pivot position, the central locking control hub 10 further including means for receiving a central support pole 80.

As shown in FIG. 9, the reconfigurable sun shade and shelter apparatus 2 comprises eight (8) support ribs 6, 8. The support ribs comprising four (4) long corner support ribs displaced at 45, 135, 225 and 315 degrees 6 and four (4) short side support ribs 8 displaced at 0, 90, 180 and 270 degrees. The support ribs 6, 8 are preferably constructed of fiberglass. The support ribs 6, 8 are preferably approximately spaced at 45 degree angles from each other and each pivotally attached to a central locking control hub 10, resembling spokes from a wheel hub. The fiberglass support ribs 6, 8 can pivot vertically from the central locking control hub 10, thereby causing the flexible shade cover 4 to be repositioned and thereby reconfiguring the sun shade and shelter apparatus. Each support rib 6, 8 is attached to a corresponding pivot mount 40 that has an inner end 42 that is pivotally connected to the housing 11 of the central locking control hub 10.

As shown in FIGS. 9*b*–9*c*, the outer end of each support rib 6, 8 comprises a support pole mount 70 for fastening a support pole, fastening rope or tent stake and a removable cover for each support pole mount. The removable support rib cover 72 is constructed of a soft rubber material press fit over the end of the support rib 6,8.

Figure 2:
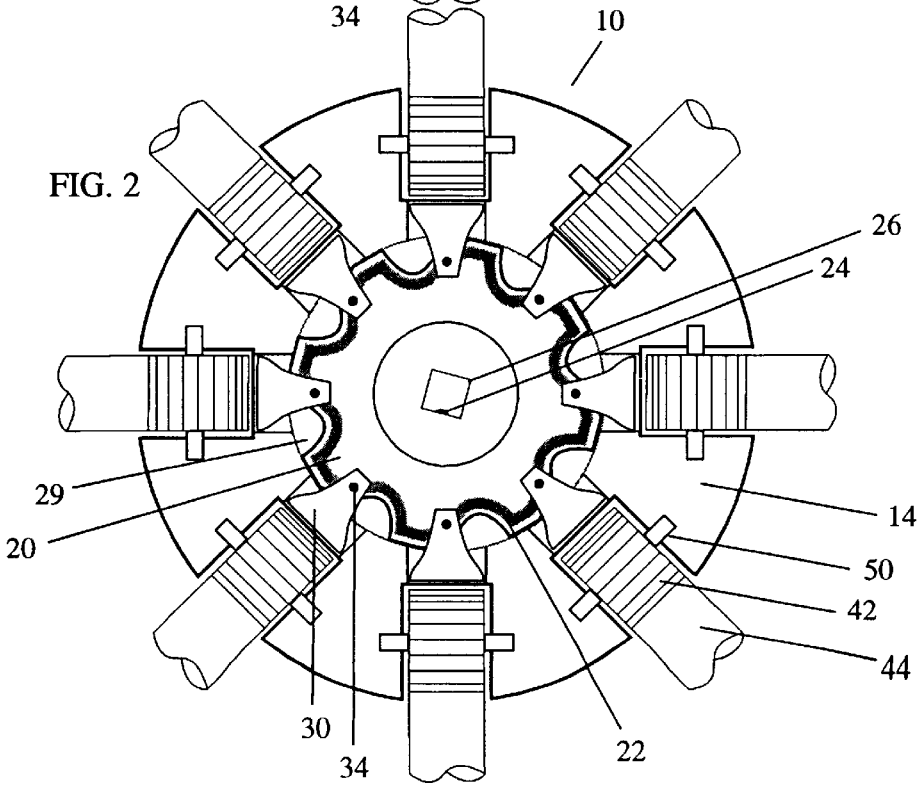
FIG. 2 is a top view with cut away of a central locking control hub in unlocked position of a reconfigurable sun shade and shelter apparatus constructed in accordance with the first preferred embodiment, where the engaging pin of the locking pistons have traveled along the cam channel.
Figure 4:
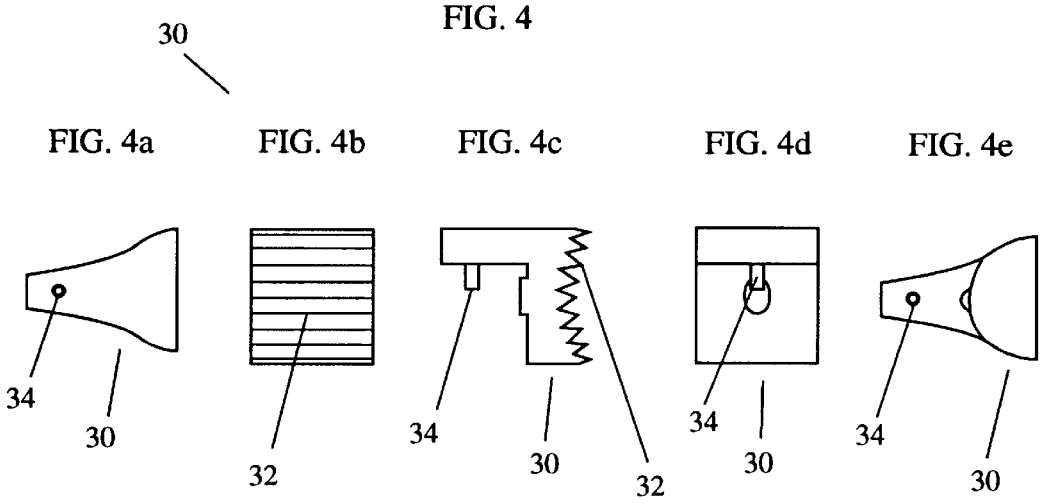
FIG. 4*a* is a top view of a locking piston.
FIG. 4*b* is a front view of a locking piston.
FIG. 4*c* is a side view of a locking piston.
FIG. 4*d* is a rear view of a locking piston.
FIG. 4*e* is a bottom view of a locking piston.
Figure 5:
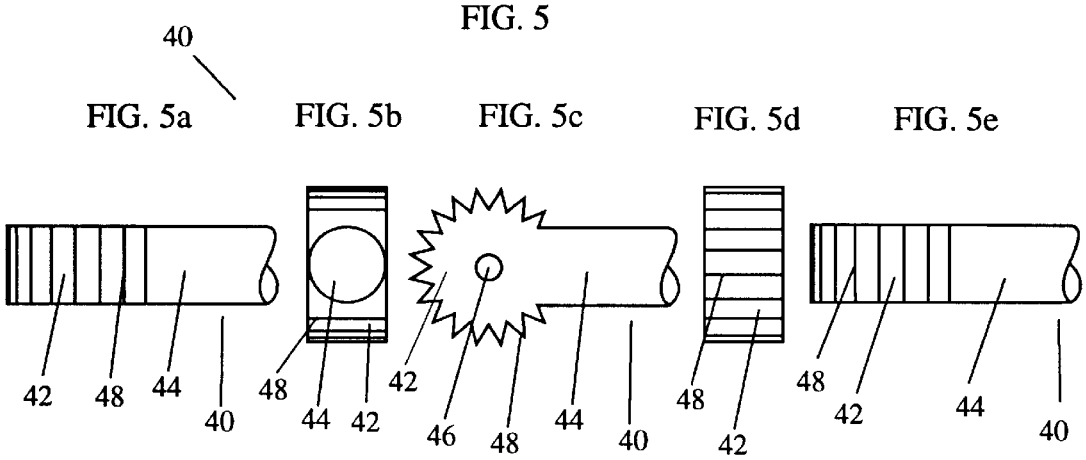
FIG. 5*a* is a top view of a pivot mount.
FIG. 5*b* is a front view of a pivot mount.
FIG. 5*c* is a side view of a pivot mount.
FIG. 5*d* is a rear view of a pivot mount.
FIG. 5*e* is a bottom view of a pivot mount.
Figure 6:
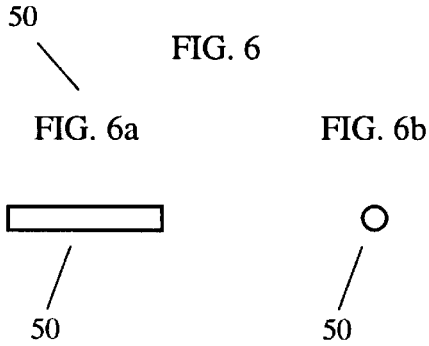
FIG. 6*a* is a top view of a pivot pin.
FIG. 6*b* is a side view of a pivot pin.

As shown in FIGS. 1 and 2, The central locking control hub 10 comprises locking means coupling the mounts 40 to the central locking control hub 10. The central locking control hub further comprises a housing 11 attached to pivot mount means 40. The locking piston means 30 are connected to cam means 20. The key means 60 is removably attached to cam means 20. The cam means is pivotally connected to the plurality of locking piston means 30 enabling the pivot mount means 40 to be independently locked into one of a plurality of possible positions.

As shown in FIG. 7, the housing 11 comprises two housing halves 12, 14 to create a housing with an opening for a cam 20 and eight (8) cylinders 16.

As shown in FIGS. 7*a*, 7*b*, and 8*a*–8*e*, the central locking control hub 10 comprises a key 60 to lock and unlock the hub. In the preferred embodiment, the key 60 is a T shaped key and the top of the T shape 62 is contoured to fit comfortably in the palm of the operator's hand or between the fingers. The base of the key 64 is preferably a square with detent holes 66 in the four sides to engage a matching detent ball 24 in the matching key receptacle 26 in the central locking control hub 10.

As shown in FIGS. 1 and 3*a*–3*d*, the key receptacle 26 is formed in the cam 20 that is displaced in a cylindrical opening 29 at the center of the housing 11 of the central locking control hub 10. The cam 20 has eight (8) cam lobes 28 equally spaced from each other. A groove 22 is situated in the top side of the cam 20 and the groove 22 continues along the perimeter of the cam 20.

As shown in FIGS. 1, 3, 4*a*–4*e*, 7*d* and 7*f*, the groove 22 continues along the perimeter of cam 20 for receiving each engaging pin 34 of the corresponding locking piston 30 such that the rotation of the cam 20 will move the locking piston engaging pin 34 along the cam groove 22 thereby moving the locking piston 30 along the cylinder 16 formed in the housing 11 of the central locking control hub 10. Each locking piston 30 has teeth 32.

As shown in FIGS. 1, 5*a*–5*e*, 6*a*–6*b*, 7*a* and 7*c*,, each locking piston 30 engages a corresponding pivot mount 40 that is rotatably connected to the housing 11 of the central locking control hub by a pin 50 mounted in a channel in the housing 11 of the central locking control hub 10. The pivot mount comprises an inner end 42 that is cylindrical from a side view and an outer end 44 that attaches to the corresponding support rib. The pin 50 is situated in a cylindrical opening 46 in the center of the pivot mount 40 that allows the pivot mount 40 to pivot about the pin 50 in a vertical plane from the central locking control hub 10. Each pivot mount 40 can independently pivot vertically at different angles from the central locking control hub 10. Each pivot mount 40 is rotatably connected to the housing 11 of the central locking control hub 10 toward the outer end of a cylinder 16 formed in the housing 11 of the central locking control hub 10. The inside cylindrical end 42 of the pivot mount comprises a plurality of teeth of a gear 48. The portion of the locking piston 30 situated away from the cam is then configured with a partial inside cylinder with teeth 32 to engage the teeth of the pivot mount.

As shown in FIG. 10*a*, the reconfigurable sun shade and shelter apparatus 2 includes a flexible shade cover 4 that is substantially square As shown in FIG. 10*b*, in a second embodiment, the reconfigurable sun shade and shelter apparatus 2 has a bottom sheet 5 that is bonded to the top sheet 4 with the support ribs 6, 8 in between the two sheets and an opening for the cam key.

As shown in FIG. 10*b*, the central locking control hub 10 comprises receiving means 23 for a vertical support pole 80 on the bottom.

Figure 11:
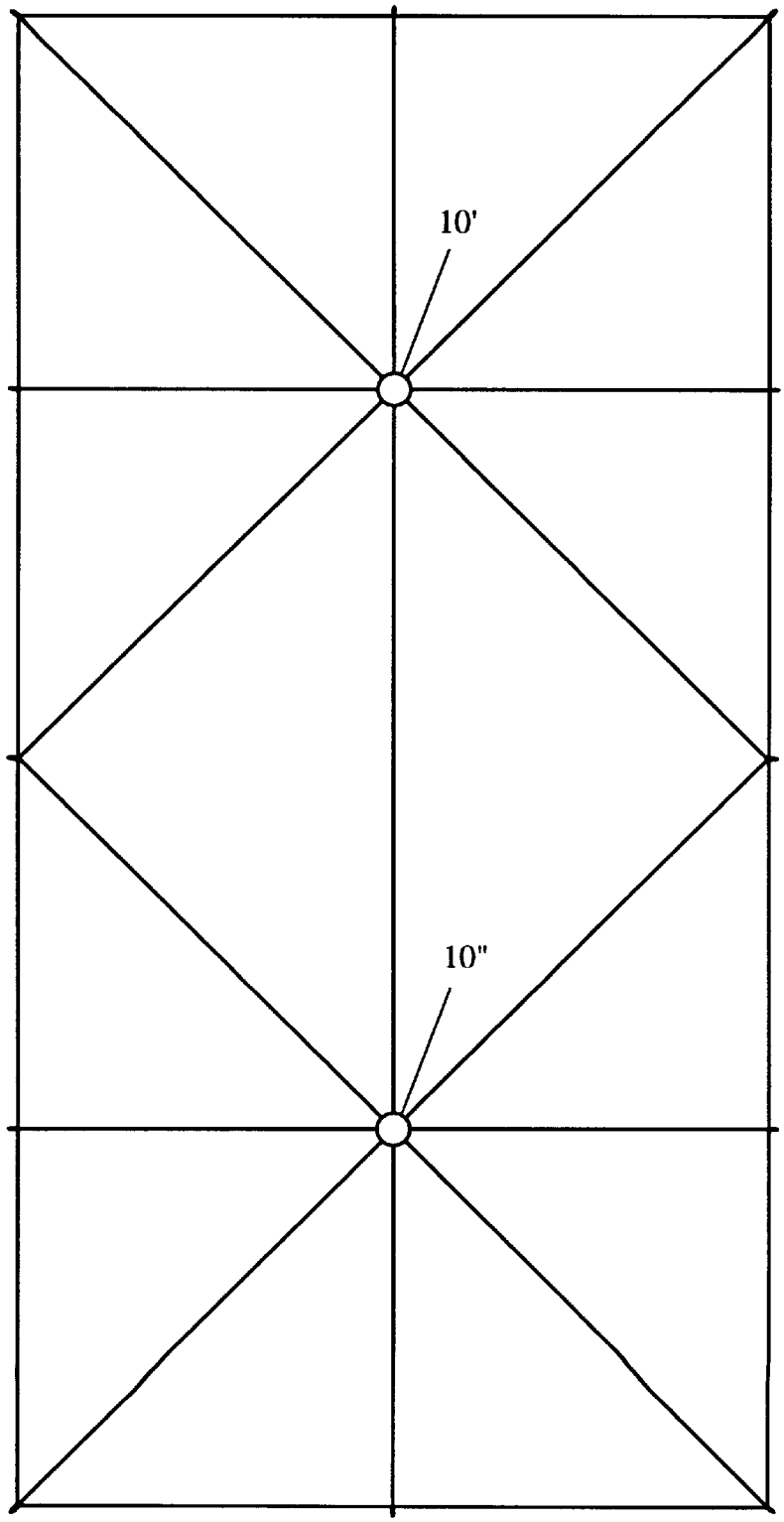
FIG. 11 is a bottom view of a reconfigurable sun shade and shelter apparatus having two central locking control hubs.

As shown in FIG. 11, in a seventh embodiment, the reconfigurable sun shade and shelter apparatus comprises a plurality of central locking control hubs.

As shown in FIGS. 12*a*–12*f* and 13*a*–13*f*, the reconfigurable sun shade and shelter apparatus can be reconfigured into a variety of shapes.

It will of course be realized that while the above has been given by way of illustrative example of this invention, all such and other modifications and variations thereto as would be apparent to persons skilled in the art are deemed to fall within the broad scope and ambit of this invention as defined in the appended claims.

What is claimed is:

1. A reconfigurable sun shade and shelter apparatus comprising:

a central locking control hub having a plurality of pivot mounts, a plurality of support ribs; and a flexible cover;

wherein the support ribs each having an inner end that is pivotally connected to the corresponding pivot mount for independently pivoting each of the plurality of support ribs such that each support rib can independently be locked into any one of a plurality of pivot positions.

2. The reconfigurable sun shade and shelter apparatus of claim 1 wherein:

the central locking control hub further comprises a cam including a plurality of lobes, a groove and a key receptacle.

3. The reconfigurable sun shade and shelter apparatus of claim 1 wherein:

the central locking control hub further comprises a housing including a plurality of cylinder openings and a plurality of locking pistons situated in the corresponding cylinder opening.

4. The reconfigurable sun shade and shelter apparatus of claim 1 wherein:

the central locking control hub further comprises a housing including a plurality of pivot pin channels and a plurality of pivot pins situated in the corresponding pivot pin housing.

5. The reconfigurable sun shade and shelter apparatus of claim 4 wherein:

the central locking control hub further comprises a plurality of pivot mounts having cylindrical openings for connecting the pivot mounts to the corresponding pivot pin.

6. The reconfigurable sun shade and shelter apparatus of claim 1 wherein:

the central locking control hub further comprises a housing having an upper housing half and lower housing half connected to form the housing.

7. The reconfigurable sun shade and shelter apparatus of claim 1 wherein the central locking control hub includes a key receptacle means having a plurality of detent balls, further comprising:

a key having a handle and a plurality of detent holes.

8. The reconfigurable sun shade and shelter apparatus of claim 1 wherein:

the support ribs further comprise an outer end having a support pole mount and a removable support rib cover.

9. The reconfigurable sun shade and shelter apparatus of claim 1 wherein:

the plurality of support ribs consists of eight (8) support ribs including four (4) long corner support ribs and four (4) short side support ribs.

10. The reconfigurable sun shade and shelter apparatus of claim 2 wherein:

the cam further comprises a plurality of detent balls.

11. The reconfigurable sun shade and shelter apparatus of claim 1 wherein the central locking control hub further comprises:

a housing having an upper housing half and lower housing half connected to form the housing, the housing further comprising a plurality of cylinder openings and a plurality of pivot pin channels and a plurality of pivot pins situated in the corresponding pivot pin housing;

a plurality of locking pistons situated in the corresponding cylinder opening;

a cam including a plurality of lobes, a groove and a key receptacle, the groove for moving the locking pistons;

a key receptacle means having a plurality of detent balls for receiving a plurality of detent holes;

a key for moving the cam having a handle and the plurality of detent holes for attaching the key to the cam; and a plurality of pivot mounts having cylindrical openings for connecting the pivot mounts to the corresponding pivot pin.

12. The reconfigurable sun shade and shelter apparatus of claim 11 wherein:

the plurality of support ribs consists of eight (8) support ribs including four (4) long corner support ribs and four (4) short side support ribs.

13. The reconfigurable sun shade and shelter apparatus of claim 1 wherein:

the support ribs further comprise an outer end having a support pole mount and a removable support rib cover.

14. The reconfigurable sun shade and shelter apparatus of claim 13 wherein:

the plurality of support ribs consists of eight (8) support ribs including four (4) long corner support ribs and four (4) short side support ribs.

15. The reconfigurable sun shade and shelter apparatus of claim 1 wherein:

the central locking control hub further comprises means for receiving a central support pole.

16. The reconfigurable sun shade and shelter apparatus of claim 1 wherein:

the flexible shade cover comprises a top sheet and a bottom sheet.

17. The reconfigurable sun shade and shelter apparatus of claim 1 wherein:

the flexible shade cover comprises a plurality of removable sections.

18. The reconfigurable sun shade and shelter apparatus of claim 1 wherein:

the central locking control hub further comprises means for receiving a central support pole.

19. A reconfigurable sun shade and shelter apparatus comprising:

a plurality of central locking control hubs each having a plurality of pivot mounts, a plurality of support ribs; and a flexible cover;

wherein the support ribs each having an inner end that is pivotally connected to the corresponding pivot mount for independently pivoting each of the plurality of support ribs such that each support rib can independently be locked into any one of a plurality of pivot positions.

20. A reconfigurable sun shade and shelter apparatus comprising:

central locking control hub means;

a plurality of support ribs; and a flexible cover;

wherein the support ribs each having an inner end that is pivotally connected to the central locking control hub and an outer end that is connected to the flexible shade cover, the central locking control hub means further including locking pivot means for independently pivoting each of the plurality of support ribs such that each support rib can independently be positioned in any one of a plurality of pivot positions and be locked into that pivot position.

* * * * *